US006397464B1

(12) United States Patent
Heigl et al.

(10) Patent No.: US 6,397,464 B1
(45) Date of Patent: Jun. 4, 2002

(54) METHOD FOR PRODUCING A VALVE SEAT

(75) Inventors: Reiner Heigl, Böbingen; Harald Pfeffinger, Tiefenbronn; Heiko Hinderer, Remseck, all of (DE)

(73) Assignees: DaimlerChrysler AG, Stuttgart; Institut für Motorenbau Prof. Huber GmbH, Munich, both of (DE)

( * ) Notice: Subject to any disclaimer, the term of this patent is extended or adjusted under 35 U.S.C. 154(b) by 0 days.

(21) Appl. No.: 09/533,713

(22) Filed: Mar. 23, 2000

(30) Foreign Application Priority Data

Mar. 23, 1999 (DE) ..... 199 12 889

(51) Int. Cl.[7] ..... B21K 1/18

(52) U.S. Cl. ..... 29/888.44; 29/888.4

(58) Field of Search ..... 29/888.44, 888.4; 123/188.3, 188.8; 251/368; 219/121.6, 121.64, 121.66

(56) References Cited

U.S. PATENT DOCUMENTS

| | | | | | |
|---|---|---|---|---|---|
| 4,034,464 | A | * | 7/1977 | Hetke | 164/132 |
| 4,378,332 | A | * | 3/1983 | Chang et al. | 148/414 |
| 4,734,968 | A | * | 4/1988 | Kuroishi et al. | 123/188.8 |
| 5,084,113 | A | * | 1/1992 | Mori et al. | 123/188.3 |
| 5,377,713 | A | * | 1/1995 | Friederich et al. | 137/1 |
| 5,492,091 | A | * | 2/1996 | Russ | 123/188.3 |
| 5,692,726 | A | * | 12/1997 | Adachi et al. | 123/188.3 |
| 5,756,520 | A | * | 5/1998 | Ask et al. | 514/316 |
| 5,794,337 | A | * | 8/1998 | Adachi et al. | 29/888.061 |
| 5,848,579 | A | * | 12/1998 | Adachi et al. | 123/188.8 |
| 5,975,039 | A | * | 11/1999 | Oshinge | 123/188.3 |
| H1869 | H | * | 10/2000 | Beardsley et al. | 123/188.3 |
| 6,138,351 | A | * | 10/2000 | Adachi et al. | 123/188.8 |

FOREIGN PATENT DOCUMENTS

| | | |
|---|---|---|
| DE | 2 200 003 | 7/1973 |
| DE | 35 17 077 | 11/1986 |
| DE | 196 39 480 | 4/1998 |
| EP | 0 092 683 | 11/1983 |
| EP | 0 228 282 | 7/1987 |

* cited by examiner

*Primary Examiner*—Irene Cuda Rosenbaum
(74) *Attorney, Agent, or Firm*—Crowell & Moring LLP

(57) ABSTRACT

In a method for producing a valve seat for a cylinder head of an internal combustion engine made of an aluminum metal alloy as the base material, an added material is fused by a laser beam with the base material of the cylinder head at the point at which the valve seat is to be formed. An alloy or a mixture of an aluminum-silicon alloy and nickel as well as at least one additional component is used as added material.

16 Claims, 1 Drawing Sheet

METHOD FOR PRODUCING A VALVE SEAT

BACKGROUND AND SUMMARY OF THE INVENTION

This invention relates to a method for producing a valve seat for a cylinder head of an internal combustion engine of the type where an added material is melted to the base material of the cylinder head by a laser beam at the place where the valve seat is to be formed A method of this type is disclosed in EP 00 92 683 B1.

In the formation of the valve seat, the base material of the cylinder head is made substantially of aluminum. The added material for the formation of the valve seat is either iron or nickel or an alloy containing one of these two metals as the chief ingredient In this method, however, the problem arises that iron and nickel have a substantially higher melting point than the aluminum of the cylinder head. When a laser beam is applied, therefore, the cylinder head is already fused when the added material first begins to melt. Moreover, it also can happen that previously molten iron has solidified while the aluminum is still molten. This leads to the formation of intermetallic phases in the boundary area between iron and aluminum, resulting in a very brittle structure. For these reasons it is very difficult to achieve a homogeneous bond between the valve seat being created and the base material of the cylinder head, and here too the different surface tensions of the materials play a great role. In the use of nickel, furthermore, considerable recycling problems are involved.

In EP 02 28 282 B1 a cylinder head is disclosed, which consists of an aluminum alloy and in which the valve seat is formed from a plated copper alloy layer. When copper is used for valve seats, however, especially in the case of Diesel internal combustion engines, the problem arises that the sulfur contained in the Diesel fuel attacks the copper, so that problems develop regarding the formation of exhaust gas and corrosion. The use of copper for valve seats is practical therefore only for Otto cycle internal combustion engines and therefore cannot be used in an economical manner.

It is therefore a primary object of the present invention to provide a method for the production of a valve seat for a cylinder head of an internal combustion engine by means of which a valve seat can be produced which has on the one hand sufficient hardness and strength characteristics and on the other hand is capable of entering into a securely adherent bond with the material of the cylinder head, without the formation of pores and fissures in the valve seat.

This object is accomplished according to the present invention by using an alloy or a mixture of an aluminum-silicon alloy and nickel as well as at least one additional alloy component as the added material.

By the use of the alloy according to the invention or of the mixture of an aluminum-silicon alloy and nickel according to the invention as the added material for the formation of the valve seat, a method that is very easy to master is the result, since the properties of this added material are very similar to those of the base material of the cylinder head. The bonding of the valve seat to the cylinder head is achieved by the method of the invention in an extremely satisfactory manner, and especially no air inclusions and fissures develop in the valve seat, so that the process is highly reliable.

By the admixture of nickel and additional alloying components a valve seat is developed which can fully satisfy the requirements of hardness and compressive strength.

In advantageous embodiments of the invention the added material can be an alloy or a mixture of $AlSi_3O$, nickel, iron and boron. This alloy or mixture gives the best results in regard to the requirements to be satisfied by the added material and by the valve seat formed thereby.

Other objects, advantages and novel features of the present invention will become apparent from the following detailed description of the invention when considered in conjunction with the accompanying drawings.

DESCRIPTION OF THE PREFERRED EMBODIMENTS

Figure 1:
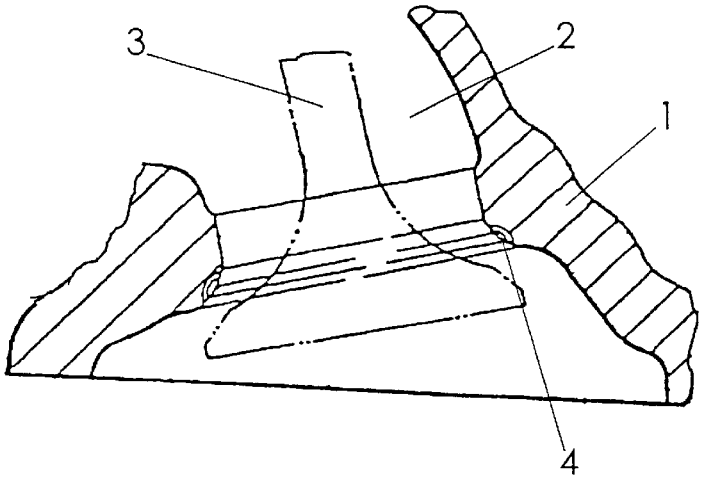
FIG. 1 is an elevational view in cross-section of a valve with a valve seat installed in a cylinder head of an internal combustion engine.

FIG. 1 shows a portion of a cylinder head 1 of an internal combustion engine not represented in its entirety. In the cylinder head 1 there is, in a known manner, an intake and exhaust port 2 which can be closed by a gas exchange valve 3, which is referred to as valve 3 for the sake of simplicity. In the cylinder head 1 there is formed a valve seat 4 against which the valve 3 strikes when closing the intake and exhaust port 2.

Figure 2:
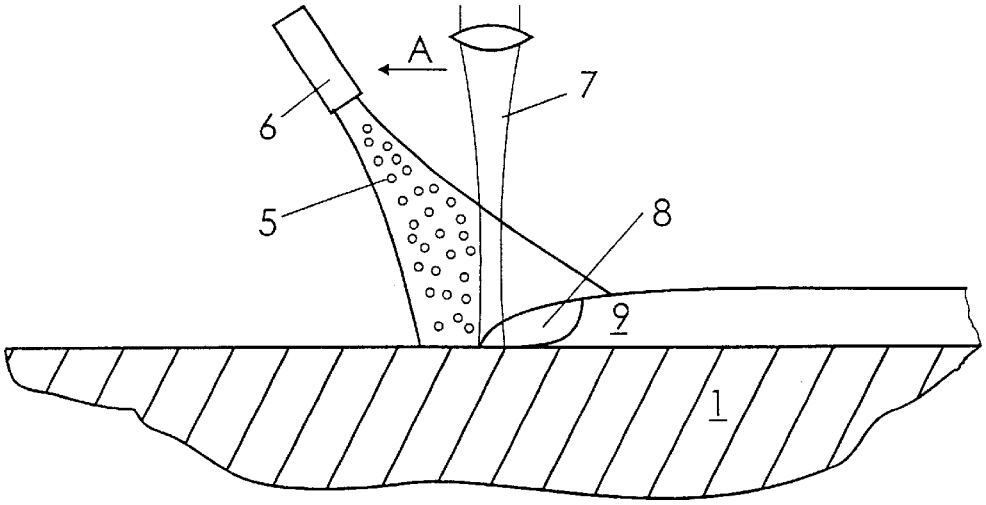
FIG. 2 illustrates the method of the present invention as a one-step process.
Figure 3:
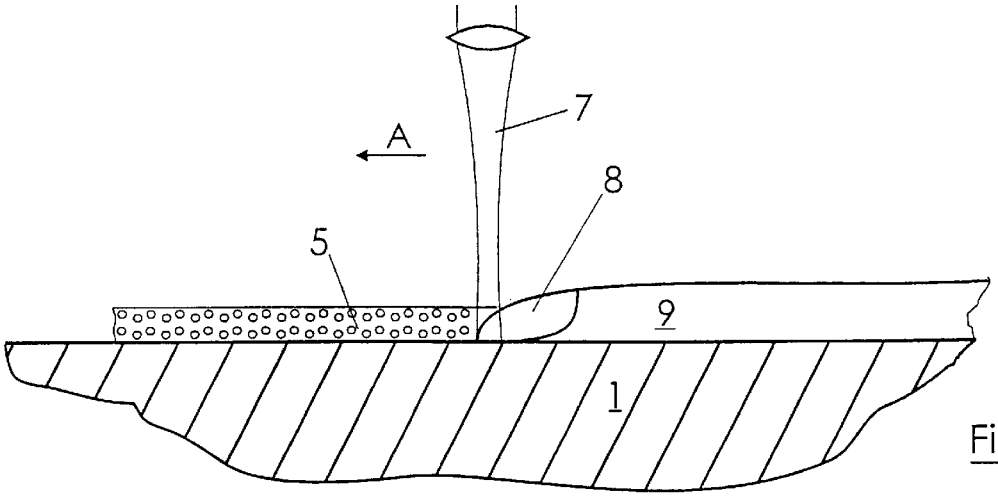
FIG. 3 illustrates the method of the present invention as a two-step process.

FIGS. 2 and 3 show two different methods for producing the valve seat 4. An added material 5 in powder form is applied to the base material of the cylinder head 1, namely an aluminum alloy such as an aluminum-silicon alloy. For this purpose a nozzle 6 is arranged near the valve seat 4 and from it the powder or added material 5 is dispensed. When the added material 5 strikes the cylinder head, it is fused simultaneously by a laser beam 7 together with the outer layer of the base material of the cylinder head 1, so that a melt 8 is formed on the cylinder head.

The nozzle 6 and the laser beam 7 are constantly moved along, requiring, of course, a circular movement on the valve seat 4. After the laser beam 7, in its circular movement, has been moved away in the direction of the arrow A from the melt 8, the latter hardens to a layer 9 which simultaneously forms the valve seat 4.

The added material 5 is in the present case an alloy or a mixture of an aluminum-silicon alloy, namely $AlSi_3O$, as well as nickel, iron and boron. The individual components amount in this case to 40 wt.-% nickel, less than 5 wt.-% iron, and 1 to 3 wt.-% boron, the remainder being formed by the aluminum-silicon alloy $AlSi_3O$. If desired, additional alloy components can also be used.

This method represented in FIG. 2 is called a one-step process.

FIG. 3 shows an alternative method for producing the valve seat 4, in which the added material 5 is used in the same composition as in FIG. 2. In this case the added material 5 is first applied in paste form, for example, to the cylinder head 1 and then fused with the laser beam 7 to the melt 8. Here too the layer 9 to form the valve seat 4 develops after the laser beam 7 is sufficiently removed in the direction of arrow A from the melt 8.

This method represented in FIG. 3 is called a two-step process.

By the two methods described the valve seat 4 of the cylinder head 1 of the internal combustion engine can be formed in a very simple manner without the formerly common pressing in of a valve seat ring and the corresponding preliminary machining of the cylinder head 1. It is not necessary to further work the valve seat, for example by machining.

This application claims the priority of German patent application No. 199 12 889.8-45, the disclosure of which is expressly incorporated by reference herein.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for the production of a valve seat for a cylinder head of an internal combustion engine which comprises an aluminum alloy as base material, said method comprising melting an added material to the base material of the cylinder head by a laser beam at the place where the valve seat is to be formed, the added material comprising an aluminum-silicon alloy or a mixture of an aluminum-silicon alloy, nickel, and at least one additional alloy component.

2. A method according to claim 1, wherein the aluminum-silicon alloy is $AlSi_3O$.

3. A method according to claim 2, wherein said added material contains approximately 40 wt.-% of nickel.

4. A method according to claim 3, wherein the additional material contains boron.

5. A method according to claim 3, wherein the additional material contains iron.

6. A method according to claim 5, containing under 5 wt.-% iron.

7. A method according to claim 5, wherein the additional material contains boron.

8. A method according to claim 2, wherein the additional material contains iron.

9. A method according to claim 2, wherein the additional material contains boron.

10. A method according to claim 9, containing about 1 to about 3 wt.-% boron.

11. A method according to claim 1, comprising applying the added material to the cylinder head simultaneously with the laser beam.

12. A method according to claim 11, further comprising applying the added material in powder form to the cylinder head.

13. A method according to claim 12, further comprising applying the added material through a nozzle to the cylinder head.

14. A method according to claim 1, comprising applying the added material to the cylinder head and then fusing the same with the base material of the cylinder head by the laser beam.

15. A method according to claim 14, further comprising applying the added material in powder form to the cylinder head.

16. A method according to claim 15, further comprising applying the added material through a nozzle to the cylinder head.

* * * * *